United States Patent [19]

Mercer

[11] Patent Number: 4,673,362

[45] Date of Patent: Jun. 16, 1987

[54] MARINE STERN DRIVE COVER

[76] Inventor: David Mercer, 600 Edgeworth St., Middlesex, N.J. 08846

[21] Appl. No.: 699,796

[22] Filed: Feb. 8, 1985

[51] Int. Cl.[4] ..... B63H 23/32

[52] U.S. Cl. ..... 440/112; 440/113

[58] Field of Search ..... 440/49, 53–64, 440/111, 112, 113, 900; 114/65 R, 174, 201 R, 221 R, 227, 361; 220/3.8; 49/463, 465; 244/129.4

[56] References Cited

U.S. PATENT DOCUMENTS

| | | | |
|---|---|---|---|
| 989,702 | 4/1911 | Gurney . | |
| 1,819,968 | 8/1931 | Patrick | 440/58 |
| 2,703,892 | 3/1955 | Steele . | |
| 2,753,827 | 7/1956 | Sabin . | |
| 2,791,095 | 5/1957 | Mercier et al. . | |
| 2,853,131 | 9/1958 | Kummerman . | |
| 2,855,038 | 10/1958 | Greer . | |
| 2,910,952 | 11/1959 | Lent et al. . | |
| 2,920,599 | 1/1960 | Leipert . | |
| 3,220,374 | 11/1965 | Sloan | 440/112 |
| 3,364,509 | 1/1968 | Lapworth | 114/357 |
| 3,368,517 | 2/1968 | MacDonald et al. | 440/57 |
| 3,487,805 | 1/1970 | Satterthwaite et al. . | |
| 3,834,340 | 9/1974 | Thorpe . | |
| 3,845,839 | 11/1974 | Eriksson . | |
| 3,913,971 | 10/1975 | Green . | |
| 4,246,859 | 1/1981 | Beckerer, Jr. . | |
| 4,303,400 | 12/1981 | Yano et al. | 440/75 |
| 4,317,655 | 3/1982 | Schick . | |
| 4,399,965 | 8/1983 | Walker | 244/129.4 |
| 4,586,909 | 5/1986 | Rosato | 440/112 |

*Primary Examiner*—Joseph F. Peters, Jr.
*Assistant Examiner*—Stephen P. Avila
*Attorney, Agent, or Firm*—Plottel & Roberts

[57] ABSTRACT

An apparatus for covering a stern drive aperture in the hull of a boat. It comprises a planar plate having a plurality of arm members projecting outwardly from its sides. It further has a hole completely through the surface of the plate which is encircled by the mouth of a hollow vessel. The apparatus is useful in protecting the exposed parts of a boat engine when the external drive mechanism is removed for storage or shipment.

18 Claims, 3 Drawing Figures

MARINE STERN DRIVE COVER

BACKGROUND OF THE INVENTION

The present invention relates to protective covers for marine stern drive units or more particularly to shields suitable for protecting exposed marine engines from damage during shipment and storage.

It is known in the art to produce motorized pleasure boats which use drive arrangements known as inboard-outboard engines. According to this configuration, a fixed gasoline or diesel powered motor resides within the body or hull of a boat. Connected to the motor is a steerable drive arrangement which comprises a propeller and means to rotate the propeller. The drive arrangement resides principally outside of the body of the boat. This drive arrangement naturally forms a seal with the hull to prevent water from entering into the motor containing compartment. When a boat is shipped overland from one location to another or is stored for any considerable length of time, such as over a winter season, it is accepted practice to remove this outer body drive arrangement to prevent damage to it. The drive arrangement is typically fastened to the motor by means of a series of bolts. However, after the drive arrangement is removed, a cavity remains in the rear of the boat thus exposing the motor to the elements. Such exposure has been found to have a detrimental impact on the motor due to entry of contaminants such as dirt and the like.

It has been a practice in the art to merely cover this aperture with a plastic wrap or cardboard. These are disadvantageous since they form a very loose seal which is easily dislodged. Furthermore, they are frequently damaged by the various bolts and drive shafts which project outwardly from the motor inside the boat hull.

The present invention seeks to solve these disadvantages by providing a relatively firm stern drive protective cover which conforms with and complements the stern aperture, as well as motor members which project out of the boat hull through said aperture.

Marine covers and hatches are well known in the art. These are exemplified by the disclosures in U.S. Pat. Nos. 2,853,131; 2,855,038; 2,753,827; 3,834,340; 989,702; 4,246,859; and 2,791,095. None of these, however, provide covers for marine motor units. U.S. Pat. Nos. 3,845,839; 2,910,952; and 2,703,892 describe certain marine seals and deflectors, however, they do not come within the purview of the present invention.

Other advantages of the invention will be in part described and in part apparent upon a consideration of the detailed description which follows.

SUMMARY OF THE INVENTION

The invention provides an apparatus for covering a stern drive aperture in the hull of a boat which comprises: a planar plate defining top and bottom surfaces and side portions, a plurality of planar arm members projecting outwardly from the sides of said plate and being in the same plane as said plate; said plate having a hole therethrough perpendicular through the planes of its top and bottom surfaces; and a hollow vessel having an opening at one end thereof, said vessel being attached to said plate such that said opening and said hole are in juxtaposition; and means for attaching said plate about said aperture.

DETAILED DESCRIPTION OF THE PREFERRED EMBODIMENT

Figure 1:
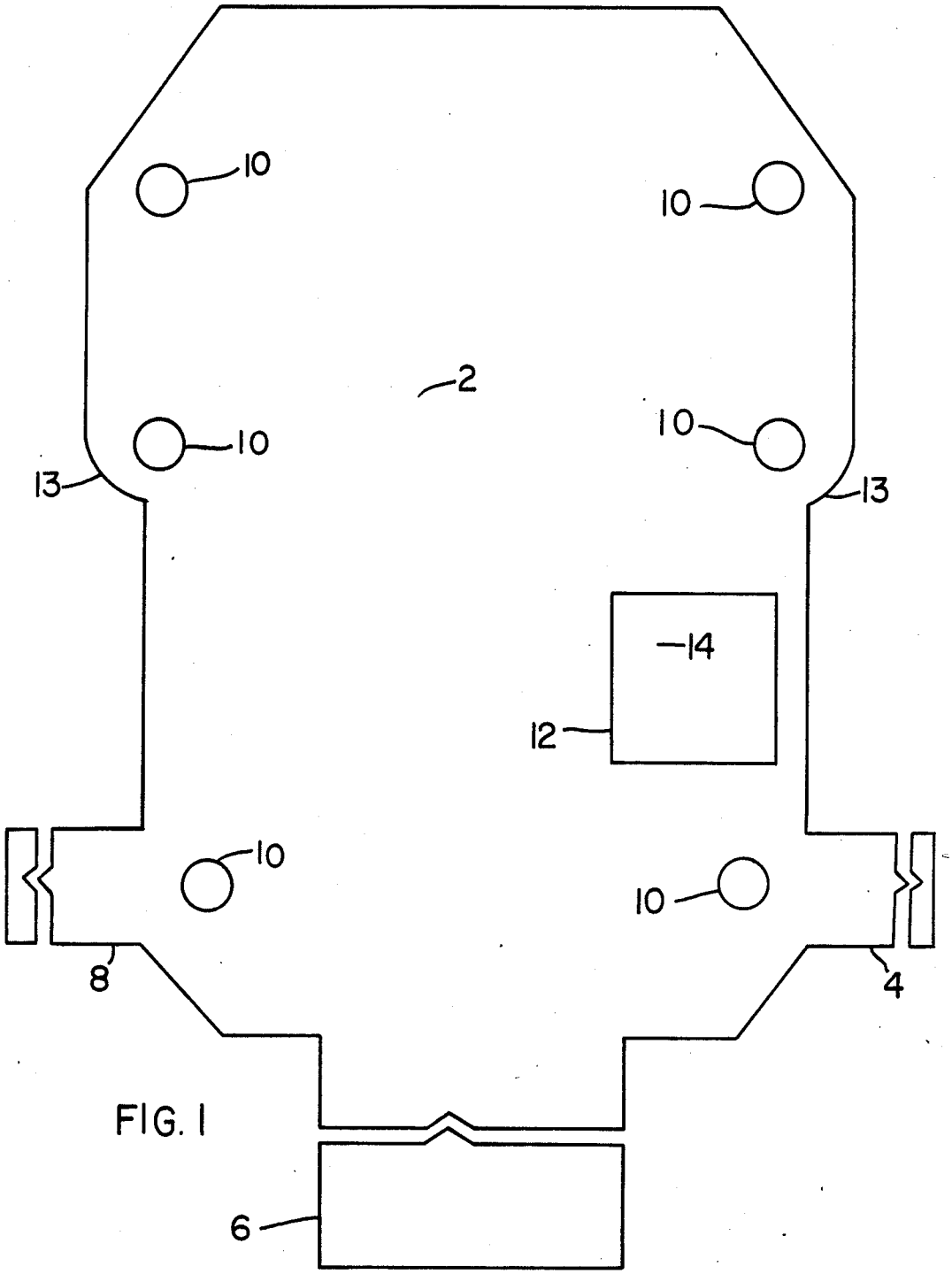
FIG. 1 is a partial plan view of the apparatus of the present invention.

As heretofore mentioned, the invention provides a marine stern drive aperture cover, which in the preferred embodiment is illustrated in FIG. 1. It is shown to comprise a planar plate member 2, which in the preferred embodiment is generally rectangular in configuration. Extending out from the sides of said plate are a plurality of arm members 4, 6, and 8. Means are provided for attaching the apparatus to the stern drive aperture of a boat. These means are preferably a plurality of mounting holes 10 which cooperate with bolts, which are not shown, which protrude from the boat engine in the boat hull. Appropriate nuts and washers are then positioned on these bolts. When the nuts are fastened, the apparatus seals itself about the hull aperture. An optional gasket or fluid seal may also be used to assist the sealing operation.

Figure 3:
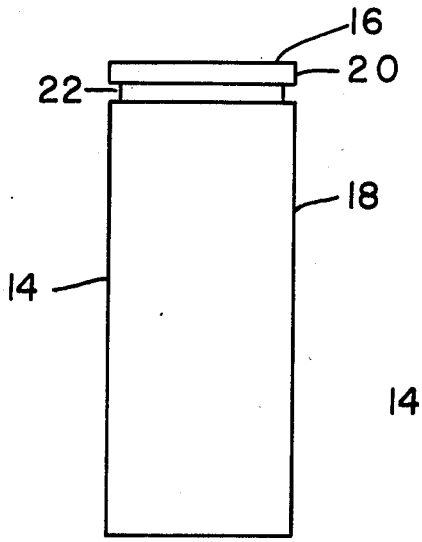
FIG. 3 is an elevational view of the vessel shown in FIG. 2.
Figure 2:
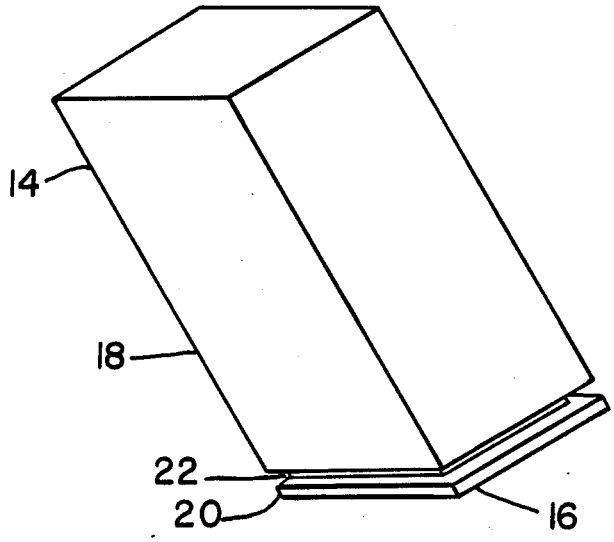
FIG. 2 is a perspective view of the vessel which attaches to the plate part of the inventive apparatus.

Through the face of the plate is a cut out hole portion 12. Fixed about this hole portion is vessel 14. This vessel is described by referring to FIGS. 2 and 3. It is shown to be a hollow vessel which has an opening 16 at one end thereof. The vessel 14 is attached to the plate such that the hole 12 and opening 16 are in juxtaposition. The purpose of this vessel is to encapsulate a corresponding member of the boat motor which protrudes out of the boat hull through said aperture. In the preferred embodiment, it is composed of a three dimensional rectangular cup having a hollow center. In the most preferred embodiment, it has a cup body 18, a lip portion 20 and a grooved part 22 therebetween. When connected to the plate 2, the body 14 slips through hole 12 such that the mouth of hole 12 snaps into position in groove 22.

In operation, the cover protects the stern drive system of the boat which consists of the bell housing, lower shift cable and slide, exhaust, drive shaft bellows, gimbal bearing and exhaust ports. Plate 2 is the main drive-shaft cover, arm 6 is the exhaust port cover and vessel 14 covers the shift cable end. Arms 4 and 8 support the tilt and trim cylinders.

As can be seen from the drawings, in the preferred embodiment the plate 2 and the arms 4, 6, and 8 are planar and generally rectangular in configuration, although these shapes may be modified as deemed fit by the skilled artisan. In the most preferred embodiment, as shown, the plate 2 is generally rectangular with the corners cut off at an angle and has rounded protruding parts 13 on alternate sides.

All of the parts can be manufactured from a wide variety of available materials. These non-exclusively include plastics, wood, and metals.

It is understood that the invention is not limited to the particular embodiments illustrated and described herein, since may modifications thereto may be made by those skilled in the art without departing from the spirit and scope of the invention as set forth in the appended claims.

What is claimed is:

1. An apparatus for covering a stern drive aperture in the hull of a boat which comprises: a planar plate defining top and bottom surfaces and side portions; a plurality of planar arm members projecting outwardly from the sides of said plate and being in the same planes as said plate; said plate having a hole therethrough perpendicular through the planes of its top and bottom surfaces; and a hollow vessel having an opening at one end thereof; said vessel being attached to said plate such that said opening and said hole are in juxtaposition.

2. The apparatus of claim 1 further comprising means for attaching said plate about said aperture.

3. The apparatus of claim 1 wherein said plate and said arm members are generally rectangular.

4. The apparatus of claim 2 wherein said plate and said arm members are generally rectangular.

5. The apparatus of claim 1 wherein said apparatus comprises one or more materials selected from the group consisting of plastics, wood and metals.

6. The apparatus of claim 2 wherein said apparatus comprises one or more materials selected from the group consisting of plastics, wood and metals.

7. The apparatus of claim 1 wherein said apparatus comprises three arm members which are positioned one on each of three side portions of said plate.

8. The apparatus of claim 2 wherein said apparatus comprises three arm members which are positioned one on each of three side portions of said plate.

9. The apparatus of claim 1 wherein said hollow vessel has a three dimensional rectangular configuration.

10. The apparatus of claim 2 wherein said hollow vessel has a three dimensional rectangular configuration.

11. An apparatus for covering a stern drive aperture in the hull of a boat which comprises: a planar, generally rectangular plate defining top and bottom surface planes and side portions; three planar, generally rectangular arm members projecting outwardly, one from each of three of said side portions and being in the same planes as the top and bottom surface planes of said plate; said plate having a hole therethrough prependicularly through the planes of said top and bottom surfaces; and a hollow vessel having an opening at one end thereof, said vessel being attached to said plate such that said opening and said hole are in juxtaposition.

12. The apparatus of claim 11 wherein said vessel has a three dimensional rectangular configuration.

13. The apparatus of claim 11 further comprising means for attaching said plate about said aperture.

14. The apparatus of claim 12 further comprising means for attaching said plate about said aperture.

15. The apparatus of claim 11 wherein said apparatus comprises one or more materials selected from the group consisting of plastics, wood and metals.

16. The apparatus of claim 12 wherein said apparatus comprises one or more materials selected from the group consisting of plastics, wood and metals.

17. The apparatus of claim 13 wherein said apparatus comprises one or more materials selected from the group consisting of plastics, wood and metals.

18. The apparatus of claim 14 wherein said apparatus comprises one or more materials selected from the group consisting of plastics, wood and metals.

* * * * *